United States Patent [19]

Eisenzimmer

[11] Patent Number: 4,550,587

[45] Date of Patent: Nov. 5, 1985

[54] HEAVY DUTY HOSE CRIMPER

[75] Inventor: George W. Eisenzimmer, Lakemore, Ohio

[73] Assignee: The Goodyear Tire & Rubber Company, Akron, Ohio

[21] Appl. No.: 561,833

[22] Filed: Dec. 15, 1983

[51] Int. Cl.[4] ..... B21D 41/04

[52] U.S. Cl. ..... 72/402; 29/237; 29/283.5

[58] Field of Search ..... 72/402, 415; 29/237, 29/282, 283.5

[56] References Cited

U.S. PATENT DOCUMENTS

| | | | |
|---|---|---|---|
| 1,480,077 | 1/1924 | Johnson | 72/402 |
| 2,231,278 | 2/1941 | Miller | 29/237 |
| 2,291,803 | 8/1942 | Grotnes | 29/282 |
| 3,093,182 | 6/1963 | Vanderhoof | 72/383 |
| 3,335,594 | 8/1967 | Peterman et al. | 72/308 |
| 3,455,140 | 7/1969 | Galan et al. | 72/416 |
| 3,461,710 | 8/1969 | Luedi et al. | 72/402 |
| 3,568,495 | 3/1971 | Duffield et al. | 72/402 |
| 3,720,088 | 3/1973 | Pauly et al. | 72/402 |
| 3,750,452 | 8/1973 | Frank | 72/402 |
| 3,762,209 | 10/1973 | Herndon et al. | 72/402 |
| 3,851,514 | 12/1974 | Chen et al. | 72/402 |
| 4,014,202 | 3/1977 | Van Allen et al. | 29/237 |
| 4,033,022 | 7/1977 | Currie et al. | 29/237 |
| 4,034,592 | 7/1977 | Chen et al. | 72/402 |
| 4,034,593 | 7/1977 | Patel | 72/402 |
| 4,050,286 | 9/1977 | Gasier et al. | 72/416 |
| 4,107,964 | 8/1978 | Smith | 72/402 |
| 4,244,091 | 1/1981 | Kimble et al. | 29/237 |

FOREIGN PATENT DOCUMENTS

| | | | |
|---|---|---|---|
| 2229479 | 12/1974 | France | 72/402 |

*Primary Examiner*—Daniel C. Crane

*Attorney, Agent, or Firm*—Frederick K. Lacher; T. P. Lewandowski

[57] ABSTRACT

Circumferentially spaced, radially movable die members for crimping are mounted in a die supporting ring positioned radially inward of circumferentially spaced radially movable pusher members engageable with the die. The die supporting ring is removably mounted on a fixed head and the pusher members are urged radially inward by axial movement of a crimping head having sloping surfaces slidably engageable with sloping surfaces of the pusher members. The slidable sloping surfaces of the crimping head and the pusher members are flat and matched by wear. The engageable surfaces of the die members and pusher members are not slidable and may have a matching configuration which is not affected by wear.

11 Claims, 9 Drawing Figures

HEAVY DUTY HOSE CRIMPER

This invention relates to a crimping apparatus for compressing a tubular fitting against the exterior of a hose. It is especially directed to providing a hose crimper capable of crimping the heaviest high pressure fittings of a two inch diameter. Hose coupling crimpers have been provided heretofore in which a frusto-conical surface of a crimping head has engaged conical surfaces of the crimping dies to urge them into crimping engagement against the coupling which is positioned around the hose. In order to provide crimping for different diameter hose and couplings the dies have been replaced with different size dies. This has caused problems due to the mismatching of the conical surfaces of the dies and the crimping head. The mismatching is caused by the uneven wear of the bearing surfaces. The necessity of changing the individual dies each time a different size fitting is crimped has also been undesirable, especially since the dies are held in place by screws, springs, clips and each one had to be individually handled. It has also been necessary to apply a lubricant to the dies which has made them difficult to handle.

In accordance with one aspect of the invention there is provided a crimping apparatus for radially compressing a tubular fitting against the exterior of a cylindrical hose comprising a first head, a crimping head mounted for relative axial movement toward and away from the first head, the crimping head having a circular opening located around an axis of the apparatus for receiving the hose and tubular fitting, a die supporting ring mounted on the first head in axial alignment with the opening in the crimping head, the die supporting ring having circumferentially spaced guides for slidably mounting die members, pusher members positioned at locations radially outward of the die members for pushing the die members radially inward against the tubular fitting, the pusher members having sloped surfaces inclined to the axis engageable with sloped surfaces on the crimping head inclined to the axis and power means for moving the crimping head and the first head together whereby sliding movement of the sloped surfaces of the pusher members along the sloped surfaces of the crimping head causes the pusher members to move radially inward forcing the die members radially inward into crimping engagement with the tubular fitting.

To acquaint persons skilled in the art most closely related to the present invention, a certain preferred embodiment thereof illustrating a best mode now contemplated for putting the invention into practice is described herein by and with reference to the annexed drawings froming a part of the specification. The embodiment shown and described herein is illustrative and as will become apparent to those skilled in these arts can be modified in numerous ways within the spirit and scope of the invention defined in the claims hereof.

Figure 1:
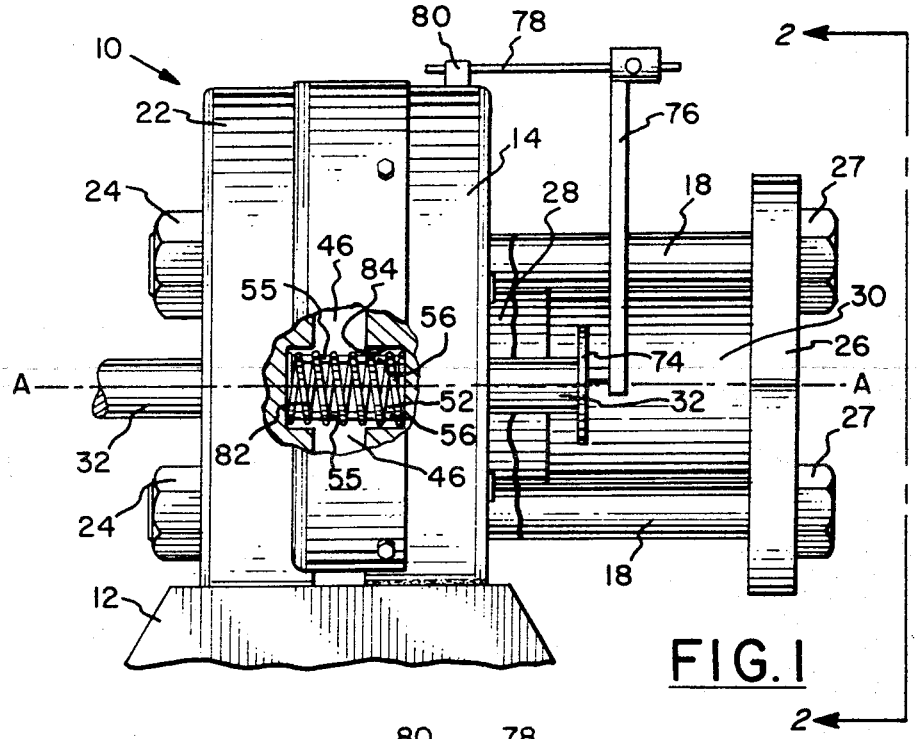
FIG. 1 is a side elevation of a hydraulic hose crimping apparatus embodying the invention with parts being broken away to show the return spring between the fixed head and crimping head and to show the stop plate mechanism.
Figure 2:
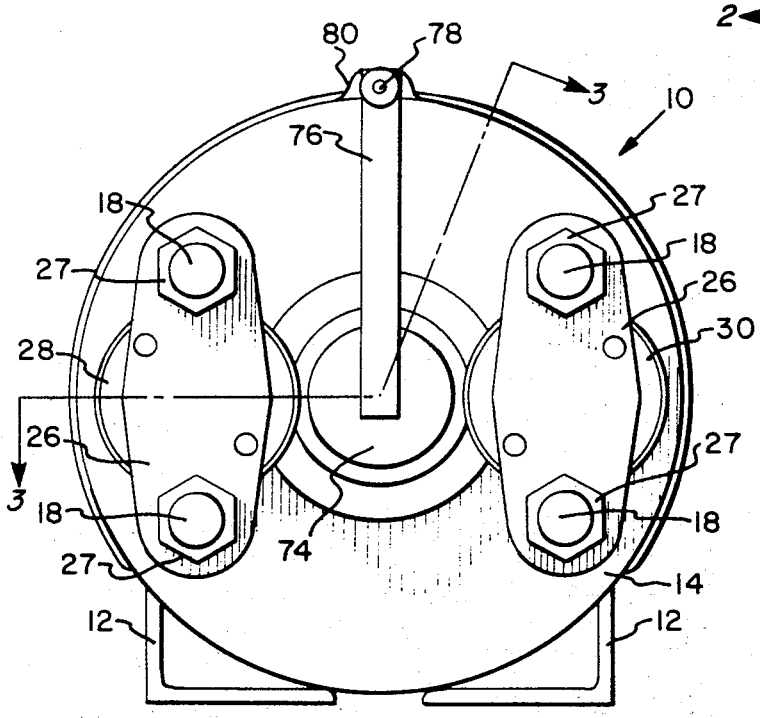
FIG. 2 is a rear elevation taken along the line 2—2 in FIG. 1.
Figure 3:
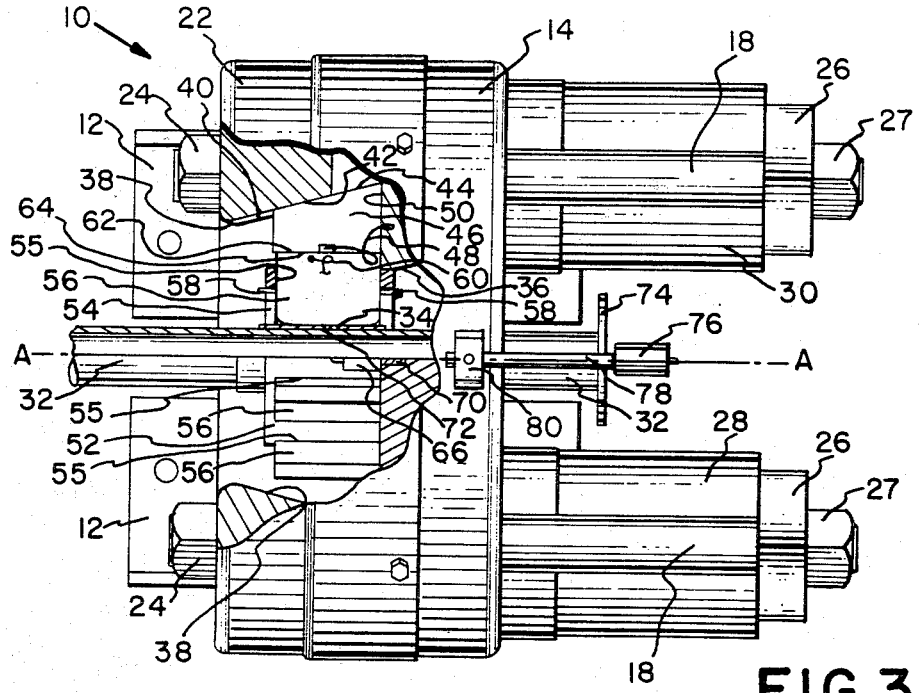
FIG. 3 is a plan view taken along the line 3—3 in FIG. 1 with parts being broken away and sectioned along the line 3—3 in FIG. 2. The crimping apparatus shown in FIG. 3 is in the open position.
Figure 5:
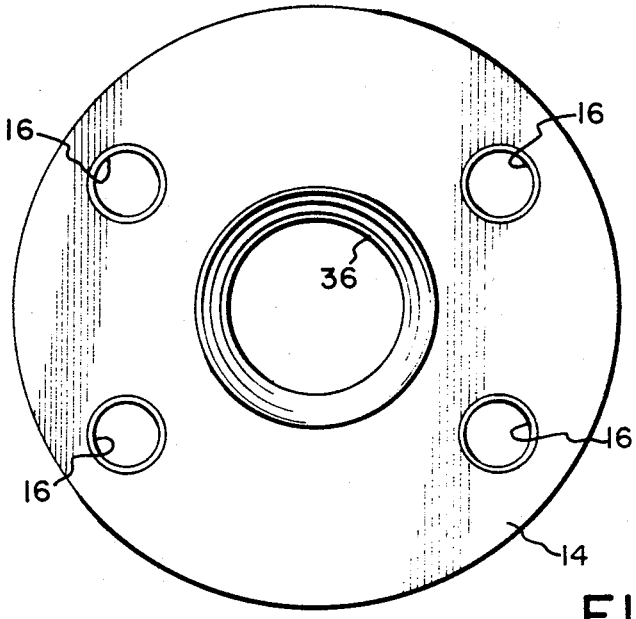
FIG. 5 is a rear view of the fixed head.
Figure 6:
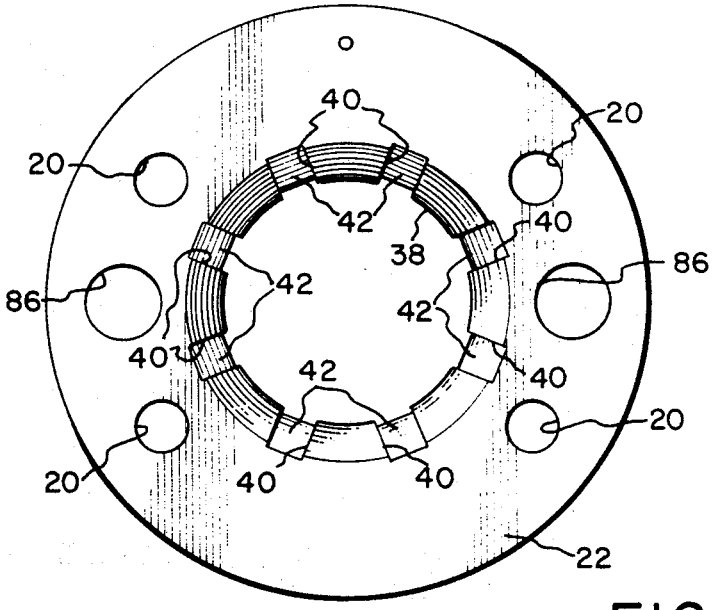
FIG. 6 is a rear view of the crimping head.
Figure 7:
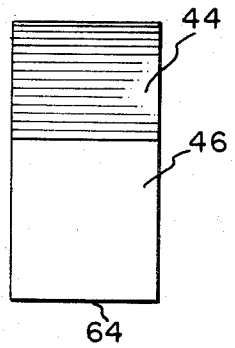
FIG. 7 is an end view of one of the pusher members.

Referring to FIGS. 1, 2, and 3 a crimping apparatus 10 is shown having a base 12 supporting a first fixed head such as annular supporting plate 14 welded to the base and shown more clearly in FIG. 5. The supporting plate 14 has cylindrical holes 16 with bearings for slidably supporting draw bars 18 extending forwardly (to the left as shown in FIG. 1) into holes 20 in a crimping head such as annular movable plate 22 positioned forwardly of the annular supporting plate 14. Nuts 24 may be threaded over the forward ends of the draw bars 18 to retain the movable plate 22 on the draw bars.

At the opposite ends of the draw bars 18 retainer plates 26 are positioned over the draw bars at each side of the apparatus 10 and retained by nuts 27 threaded on the rearward ends of the draw bars as shown in FIG. 2. Interposed between the retainer plates 26 and the supporting plate 14 are hydraulic cylinders 28 and 30 which may be fastened to the retainer plates 26 and contain pistons (not shown) connected to the supporting plate 14. These cylinders 28 and 30 provide a power means for the crimping apparatus 10 and are in communication with a source of hydraulic fluid pressure actuated by controls of a type well known to those skilled in the art.

Figure 4:
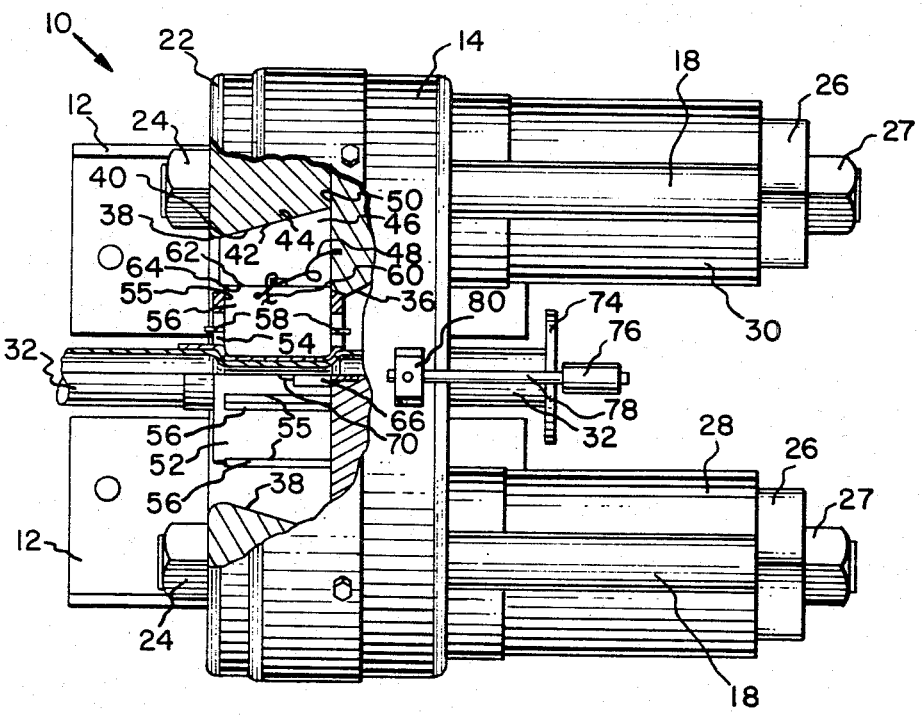
FIG. 4 is a view like FIG. 3 but showing the dies in crimping engagement with the tubular fitting.

Referring to FIGS. 1, 3 and 4, a cylindrical hose 32 is shown positioned in the crimping apparatus 10 and inserted in a tubular fitting such as sleeve 34. The axis of the hose 32 is coaxial with axis A—A of the crimping apparatus 10 and the supporting plate 14 has a circular opening 36 about the axis to receive the hose. The movable plate 22 also has a circular opening 38 through which the hose 32 and sleeve 34 may extend.

Spaced circumferentially around the opening 38 of the movable plate 22, are radially extending slots 40 having sloped flat surfaces 42 engageable with sloped flat surfaces 44 of circumferentially spaced pusher members 46. Pusher springs 48 resiliently connect the pusher members 46 to the supporting plate 14 and, as shown in FIGS. 3 and 4, the pusher springs urge the pusher members radially outward against the sloped flat surfaces 42 of the slots 40 in the movable plate 22 and also permit the pusher members to slide radially along a radial surface 50 of the supporting plate 14.

A die supporting ring, which in this embodiment includes two semicircular die cages 52 and 54, is also supported on the supporting plate 14 in axial alignment with the opening 36 in the supporting plate and the opening 38 in the movable plate 22. Each of the die cages 52,54 have guides such as circumferentially spaced, radially extending slots 55 for slidably supporting die members 56. Each of the die members 56, as shown more clearly in FIG. 8, has stops such as pins 58 extending outwardly from the die members for limiting the radial outward movement of the die members in the die cages 52,54. Die springs 60 are connected to the die cages 52,54 and the respective die members 56 for urging the die members radially outward and retaining the die members in the cages.

Figure 8:
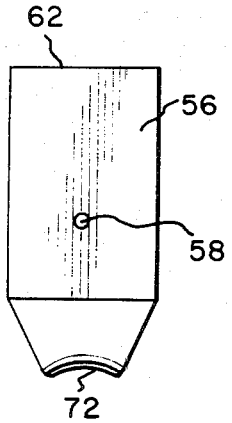
FIG. 8 is an end view of one of the dies.
Figure 9:
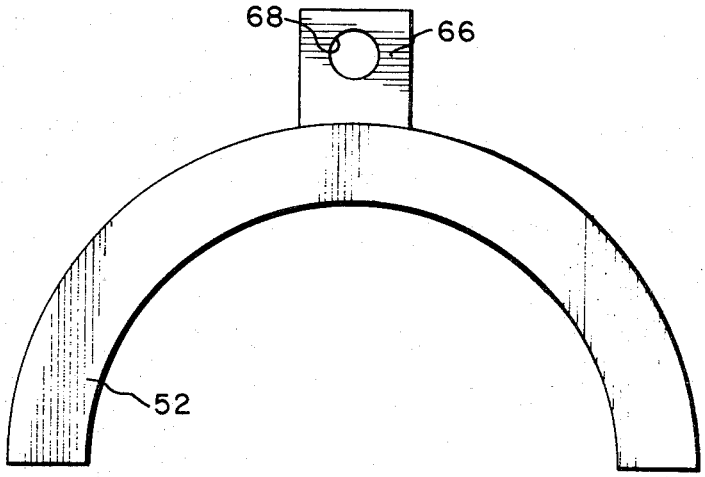
FIG. 9 is an end view of one of the semicircular sections of the die supporting ring.

The die cage 52, shown in FIG. 9, is identical with die cage 54. Each of the die cages 52,54 has a supporting block 66 fastened to the cage with a passage 68 for receiving a locating pin 70 threaded in the supporting plate 14 adjacent the opening 36 to support the cages in operating position. Die cages 52,54 having die members 56 of different sizes may be utilized with this crimping apparatus 10. To adapt the apparatus 10 to crimp a hose 32 and sleeve of a certain size, the die cages 52,54 containing the desired size of die members 16 are mounted on the supporting head 14 and it is not necessary to insert or remove the die members individually. As shown in FIGS. 3, 4 and 8, each of the die members 56 has an axially extending bearing surface 62 for engaging an axially extending bearing surface 64 of one of the pusher members 46. Each of the die members 56 also has a curved crimping surface 72, as shown in FIG. 8, conforming to the curvature of the sleeve 34 to be crimped on the hose 32. The bearing surface 62 of the die members 56 may be flat or of any convenient flat mating shape for engaging the bearing surface 64 of the pusher member 46 because there is substantially no wear due to sliding of these surfaces one on the other.

The sloped flat surfaces 42 of the slots 40 in the movable plate 22 and the sloped flat surfaces 44 of the pusher members 46 are in sliding engagement and may wear in service; however, the surfaces continue to be matched as they wear together. A lubricant such as grease is used on the sloped flat surfaces 44 of the pusher members 46 and the surfaces of the pusher members which slide on the radial surface 50 of the supporting plate 14. However, no lubricant is required on the die members 56 or the die cages 52,54 making them easy to handle and service.

In operation the hose 32 with the sleeve 34 mounted thereon is inserted through the opening 38 in the movable plate 22 and through the opening 36 in the supporting plate 14 until the end of the hose abuts a stop plate 74. The stop plate 74 may be adjustably mounted for axial movement relative to the supporting plate 14 by an arm 76 connected to the stop plate and slidably mounted on a rod 78 held in a pad 80 mounted on the supporting plate 14. The stop plate supporting members also include suitable means for accommodating axial movement of the end of the hose 32 during the crimping operations.

Resilient means such as return springs 82 may be mounted in opposing recesses 84 and 86 in the supporting plate 14 and movable plate 22, respectively for holding the supporting plate and movable plate apart during the insertion of the hose 32 and sleeve 34 into the crimping apparatus 10. The stop plate 74 may also serve as a trigger plate with a switch being mounted in the adjusting pad 80 for actuation when the hose 32 engages the stop plate. The switch in turn actuates suitable controls (not shown) to admit hydraulic fluid under pressure into the hydraulic cylinders 28 and 30 causing the retainer plates 26 to be moved to the right as shown in FIG. 4. The draw bars 18 then pull the movable plate 22 to the right causing the pusher members 46 to slide in the slots 40 and move radially inward forcing the die members 56 radially inward into crimping engagement with the sleeve 34. The distance the movable plate is moved to the right relative to the supporting plate 14 may also be set by the controls to regulate the radial crimping movement of the die members 56. After crimping of the sleeve 34 the desired amount, the pressure of the hydraulic fluid in the cylinders 28 and 30 is reduced and the return springs 82 cause the movable plate 22 to return to the position shown in FIG. 3. The pusher springs 48 and die springs 60 then act to return the pusher members 46 and die members 56 to the open position shown in FIG. 3. The hose 32 and crimped sleeve 34 may then be pulled out of the crimping apparatus 10 and the next hose and sleeve assembly inserted.

While a certain representative embodiment and details have been shown for the purpose of illustrating the invention, it will be apparent to those skilled in the art that various changes and modifications may be made therein without departing from the spirit or scope of the invention.

What is claimed is:

1. A crimping apparatus for radially compressing a tubular fitting against the exterior of a cylindrical hose comprising a first head, a crimping head mounted for relative axial movement toward and away from said first head, said crimping head having a circular opening located around an axis of the apparatus for receiving said hose and tubular fitting, a die supporting ring mounted on said first head in axial alignment with said opening in said crimping head, said die supporting ring having circumferentially spaced guides, die members slidably mounted in said guides so that said die members are radially positioned thereby establishing said opening, pusher members positioned at locations radially outward of said die members and in unconnected contact with said pusher members for pushing said die members radially inward against said tubular fitting, means connecting each of said die members to the die supporting ring and urging said die members radially outward to an open position in said die supporting ring, said pusher members having sloped flat surfaces inclined to said axis engageable with sloped flat surfaces on said crimping head inclinded to said axis and power means for moving said crimping head and said first head together whereby sliding movement of said sloped flat surfaces of said pusher members along said sloped flat surfaces of said crimping head causes said pusher members to move radially inward forcing said die members radially inward into crimping engagement with said tubular fitting and pusher means connecting said first head and each of said pusher members to urge said pusher members radially outward against said sloped flat surfaces on said crimping head and permit said pusher members to slide radially along a radial surface of said first head.

2. A crimping apparatus in accordance with claim 1 wherein said first head is a fixed head and said crimping head is moved toward said fixed head by said power means to provide sliding movement of said sloped flat surfaces of said pusher members along said sloped flat surfaces of said crimping head.

3. A crimping apparatus in accordance with claim 1 wherein said guides in said die supporting ring are radially extending slots for receiving and slidably mounting said die members.

4. A crimping apparatus in accordance with claim 1 wherein said first head has a circular opening located around said axis of the apparatus for receiving said hose and tubular fitting.

5. A crimping apparatus in accordance with claim 1 wherein a hose locater is mounted on said first head and includes a stop plate in position for abutting the end of said hose and said stop plate being fastened to an arm adjustably mounted for axial movement on said first head.

6. A crimping apparatus in accordance with claim 1 wherein said connecting means comprise die springs resiliently connecting said die supporting ring and each of said die members.

7. A crimping apparatus in accordance with claim 1 wherein said pusher means comprise springs resiliently connecting said first head and each of said pusher members.

8. A crimping apparatus in accordance with claim 1 wherein said power means includes at least one hydraulic cylinder positioned on the opposite side of said first head from said crimping head and connected to said crimping head for urging said crimping head toward said first head to radially compress said tubular fitting, and at least one return compression spring positioned between said first head and said crimping head for urging said crimping head away from said first head to open said apparatus.

9. A crimping apparatus in accordance with claim 1 wherein each of said die members has an axially extending flat bearing surface for engaging an axially extending flat bearing surface of one of said pusher members in response to radially inward movement of said pusher members to force said die members radially inward into crimping engagement with said tubular fitting.

10. A crimping apparatus in accordance with claim 1 wherein said die supporting ring is releasably mounted on said first head and additional die supporting rings may have die members of different sizes so that the desired size die members for crimping the tubular fitting of a particular size can be provided by mounting a die supporting ring containing said desired size die members on said first head.

11. A crimping apparatus in accordance with claim 10 wherein said die supporting ring includes at least two semicircular die cages each of which contains means for receiving a locating pin mounted on said first head adjacent said opening to support said semicircular die cages in axial alignment with said opening in said first head.

* * * * *